US006086751A

United States Patent [19]

Bienstock et al.

[11] Patent Number: 6,086,751

[45] Date of Patent: Jul. 11, 2000

[54] THERMAL PROCESS FOR REDUCING TOTAL ACID NUMBER OF CRUDE OIL

[75] Inventors: Marty G. Bienstock, Succasunna, N.J.; John G. Matragrano, Baton Rouge, La.; Rutton Dinshaw Patel, Berkeley Heights, N.J.; Roby Bearden, Jr., Baton Rouge, La.

[73] Assignee: Exxon Research and Engineering Co, Florham Park, N.J.

[21] Appl. No.: 08/920,549

[22] Filed: Aug. 29, 1997

[51] Int. Cl.[7] ..... C10G 17/00

[52] U.S. Cl. ..... 208/263; 208/47

[58] Field of Search ..... 208/263, 47

[56] References Cited

U.S. PATENT DOCUMENTS

| | | | |
|---|---|---|---|
| 1,953,353 | 4/1934 | Lazar | 196/1 |
| 2,040,104 | 5/1936 | Radasch | 208/263 |
| 2,227,811 | 1/1941 | Moser | 208/263 |
| 4,995,495 | 2/1991 | Krynski | 196/46 |
| 5,250,175 | 10/1993 | Des Ormeaux | 208/356 |
| 5,820,750 | 10/1998 | Blum | 208/263 |

*Primary Examiner*—Helane Myers
*Attorney, Agent, or Firm*—Jay Simon

[57] ABSTRACT

TAN containing oils, e.g., crudes, are treated by flashing to remove substantially all of the water therefrom, thermally treating the recovered liquid to reduce the naphthenic acid content thereof, and re-combining light gases recovered from the flashing step with the treated liquid.

23 Claims, 3 Drawing Sheets

THERMAL PROCESS FOR REDUCING TOTAL ACID NUMBER OF CRUDE OIL

FIELD OF THE INVENTION

This invention relates to the treatment of crude oil, including heavy crudes, for reducing the total acid number (TAN) of the oil.

BACKGROUND OF THE INVENTION

The value of crude oils is often dependent on the corrosivity of the oil, and corrosivity is mainly a function of the total acid number of the oil. TAN, in turn, is heavily dependent, although not completely so, on the naphthenic acid concentration of the oil. Consequently, crudes having a relatively high TAN, e.g., ≧2 have a significantly lower market value, on a per barrel basis, than crudes having a relatively lower TAN. For example, high TAN crudes are often blended off with lower TAN crudes rather than being processed separately through refineries, thereby avoiding excessive corrosion in refinery equipment. Processing of high TAN crudes can also necessitate the use of expensive alloys in primary equipment, e.g., pipestills, thereby minimizing corrosivity effects of the crudes. Both methods for handling high TAN crudes are expensive and can lead to excessive storage facilities or upsets in the refinery. Consequently, there remains a need for handling high TAN crudes that is not disruptive of refinery operations and avoids excessive costs.

SUMMARY OF THE INVENTION

In accordance with this invention, TAN containing oils, e.g., crudes, extra heavy oils, bitumens, kerogens, are pretreated by flashing off vapors including light gases, water, and light hydrocarbons, subjecting the remaining liquid phase to a thermal treatment wherein naphthenic acids are decomposed and TAN is reduced, followed by recombining at least a portion of the hydrocarbon vapors recovered from the flash with the treated liquid.

The thermal treatment of this invention is not to be confused with visbreaking which is essentially a treatment of heavy oils or whole crudes at temperatures in excess of the temperatures of the thermal treatment disclosed herein.

TAN reductions in accordance with this invention are preferably on the order of at least 70%, more preferably at least about 80%, still more preferably at least about 90%.

In the practice of this invention the oil to be treated may or may not be subjected to desalting prior to the flashing of the light materials. Desalting is generally preferred with oils having in excess of 2 pounds of salt per thousand barrels of oil and more preferably when the salt level exceeds 4 pounds of salt per thousand barrels of oil. Desalting is a common process and will be well known to those skilled in the art of refining.

In many cases, particularly where heavy crudes, e.g., Bachaquero, Morichal, Cerro Negro, Zuata, or Campo-1-Bare, all Venezuelan heavy crudes, and cases involving bitumens, the crude or heavy oil is diluted with naphtha to provide ease of transportation, e.g., pumpability. In the flashing step, the diluent will be vaporized along with $C_4$-gases (e.g., light-ends), water, and anything else that will be vaporized at the flashing conditions of about 250 to 700° F., and pressures ranging from atmospheric to about 250 psig. The extent of the flash step is largely determined by removing substantially all of the water present in the oil, e.g., to levels of less than about 0.5 wt %, preferably less than about 0.1 wt %. The flashed hydrocarbons, e.g., light gases, naphtha diluent, or light hydrocarbons are recovered from the flash and maintained for later combining of at least a portion thereof, and substantially all, with the product of the thermal treatment.

The thermal treating process described herein is distinguished from Visbreaking (a thermal treating process) by temperature and overall severity of the operation, as well as by operation at conditions that maintain water partial pressure in the reaction zone below a certain level. For purposes of this invention we define severity in terms of equivalent seconds at 875° F., using the following equation:

$$\theta_{875°F.} = 60 \times \exp\left[\left(\frac{Ea \times 1.8}{1.987}\right)\left(\frac{1}{875+460} - \frac{1}{T\ °F.+460}\right)\right]$$

Where: $\theta_{875°\ F.}$=Equiv seconds at 875° F. for 1min. operation at T° F.

Ea=Activation energy in cal./g-mole (53,000 Cal/g-mole typical for Visbreaking)

Visbreaking is typically carried out in one of two configurations, a coil reactor that is contained within a furnace or in a "soaker reactor". The former operates at temperatures in the range of about 850–910° F. with a coil outlet pressure of up to about 1000 psig or above. The soaker reactor operates at an average temperature in the range of about 820° F. at pressures ranging from about 30 to 500 psig. Thermal treatment severities for both of these visbreaking processes fall in the range of about 100–200 equivalent seconds at 875° F. There is no specification on water partial pressure in Visbreaking. Operation at Visbreaking severities is neither needed nor desired for the practice of the present process where the objective is to destroy carboxylic acids (e.g., naphthenic acids) with minimal cracking of the oil.

The process of this invention comprises the following steps: preflash to remove any water that is present in the feed, mild thermal treating in a purged low-pressure reactor of two or more stages and a final step wherein light hydrocarbons that are recovered from either thermal treating or from the pre-flash are recombined with the reactor effluent to obtain a low TAN upgraded crude oil. The thermal treating reactor operates at 650–800° F., preferably 675–775° F. and most preferably from 700–750° F. Pressure is maintained below about 100 psig, preferably below about 50 psig. Reaction severity falls in the range of 10 to about 80 equivalent seconds at 875° F., preferably from about 20 to 60 equivalent seconds. At a treatment temperature of 725° F., for example, reaction time will fall in the range of 17–134 minutes.

Figure 1:
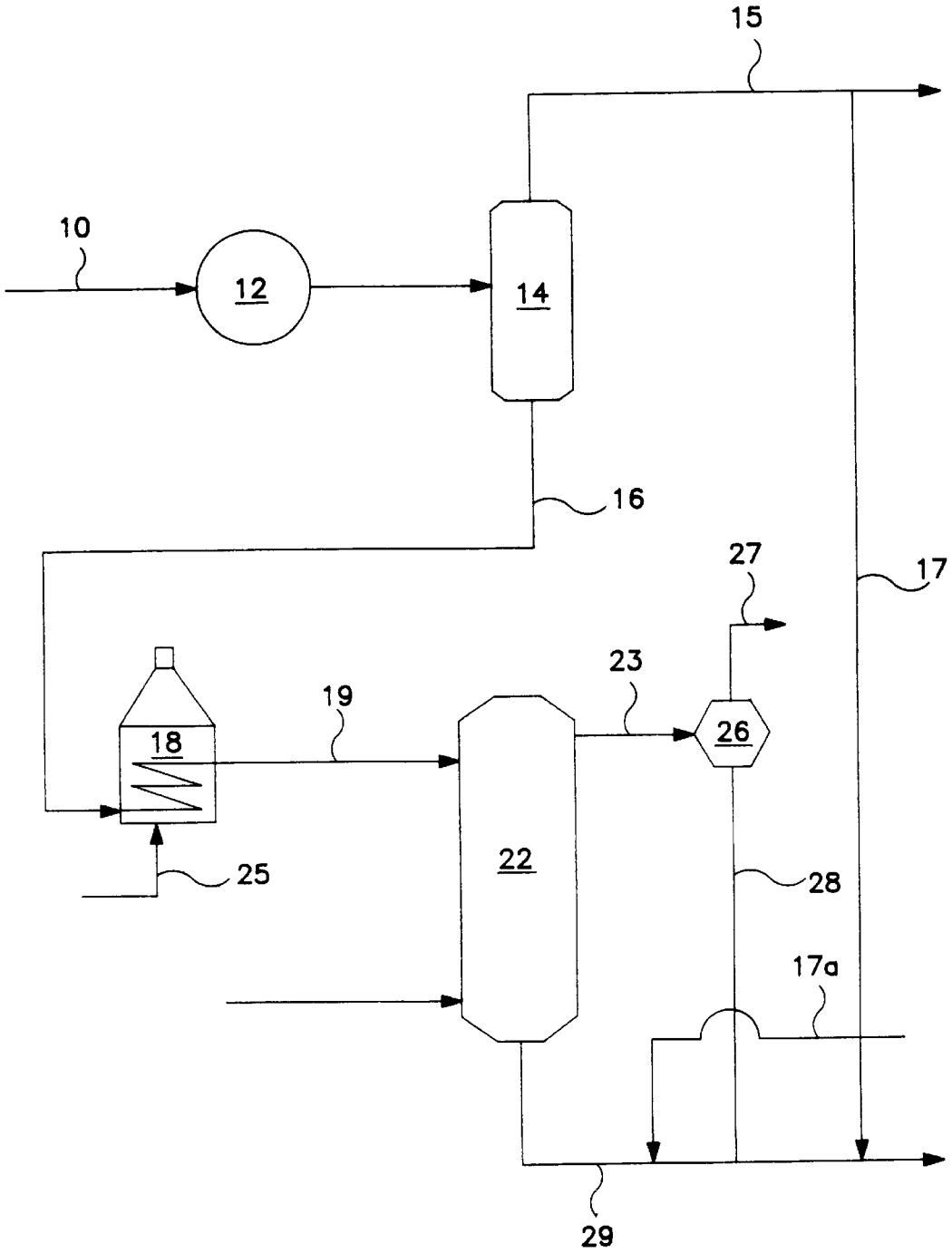
FIG. 1 is a schematic flow plan illustrating the process of this invention.

Turning to FIG. 1, crude from an available source, whether diluted for transportation purposes, or not, in line 10 is processed through desalter 12, cool ed and flashed in flash drum 14 from which diluent, if any, water and light hydrocarbons, including gases are recovered in line 15. The flashed crude, recovered in line 16 is heated in furnace 18 and injected into a staged bubble column 22 via line 19. A purge gas, as described below, is preferably injected into column 22 via line 21 and engages in counter current contact with the flashed crude. The purge gas, along with any light hydrocarbons forming via cracking in the bubble column, is recovered in line 23, condensed in condenser 26 from which fuel gas is recovered for re-use in line 27. Condensed light hydrocarbons are recovered in line 28 and recombined with the treated crude fraction in line 29 to form an upgraded crude.

In preferred embodiments of this invention, at least a portion of the light hydrocarbons, stripped of water and preferably stripped of diluent, if any, recovered in line 15 is recombined with the treated crude by line 17 or line 17*a*; and a portion of the recovered hydrocarbons from line 15 or line 28 or both is combusted in furnace 18 through line 25.

As illustrated in examples to follow, control of water partial pressure in the thermal reaction zone is important to the success of the present process. Water has been discovered to act as a powerful inhibitor for the thermal decomposition of naphthenic acids (see Ser. No. 571,049 filed Dec. 12, 1995) now abandon. Moreover, we have found that inhibition of TAN conversion also inhibits viscosity reduction. Consequently, water (steam) partial pressure in the reaction zone is held below about 10 psia, preferably below about 5 psia and most preferably below about 2 psia. Thus, the need for removal of bulk water from the feed. Additionally, since water is produced by decomposition of carboxylic acids, the reaction zone must be purged with inert gas (e.g. methane) to control water partial pressure. Carbon dioxide, also an inhibitor for acid decomposition is formed in the process and is purged from the reactor along with water. Purge rate is chosen consistent with pressure and level of water in the reaction zone, will generally fall in the range of 50–500 SCF/barrel. Suitable purge gases include non-oxidizing gases, such as nitrogen, methane, well-head gas (fuel gas) hydrogen and carbon monoxide.

The thermal treatment process of this invention is designed to minimize cracking of the hydrocarbons, yet maximize the decomposition of naphthenic acids. Nevertheless, during the thermal treatment some cracking of the oil will occur and small amounts of light hydrocarbon gases, i.e., butanes and lighter, will be obtained along with $H_2O$, CO, and $CO_2$ that arise from decomposition of the acids. The yield of hydrocarbon gases is low at the mild severities used, and will range from about 0.5 to 2.0 wt % based on feed.

Thermal treatment is taken, for this invention in its normal meaning and for purposes of this invention also includes the absence of any catalyst for promoting the conversion of naphthenic acids, the absence of any material added to react with or complex with naphthenic acids, and the absence of absorbents for naphthenic acids, i.e., the absence of any material used for the purpose of removing naphthenic acids.

The thermal treatment is carried out to reduce significantly the oil's TAN, e.g., to levels of less than about 2.0 mg KOH/gm oil, preferably less than about 1.5 mg KOH/gm oil, more preferably less than about 1.0 mg KOH/gm oil, and still more preferably less than about 0.5 mg KOH/gm oil as measured by ASTM D-664.

The oils that can be effectively treated by this process include whole or topped crudes, crude fractions boiling above about 400° F., atmospheric residua and vacuum gas oils, e.g., boiling at about 650° F.+, e.g., 650–1050° F.

During the thermal treatment, any cracked hydrocarbons and light gases can be separately recovered and at least a portion thereof may be re-combined with the treated oil. In a preferred embodiment, a portion of the $C_4$-materials produced in the treatment or a portion of the hydrocarbons produced and recovered from the flash step, preferably minor portions thereof, e.g., less than 50%, preferably less than 40%, more preferably less than 25%, is combusted to provide pre-heat for heating the liquid to be thermally treated or to provide heat for the treating zone.

Upon recovery of the liquid product, and preferably the liquid product plus at least a portion of the hydrocarbons recovered as vapors from the treating zone, i.e., cracked products or light hydrocarbons, or both, the vaporous hydrocarbons, or at least a portion thereof recovered from the flash step are also recombined with the treated liquid. Of course, the vaporous hydrocarbons recovered from the treating step may be recombined with the liquid before or after recombination with vaporous hydrocarbons from the flashing step.

The final recombined product may then be further processed in a refinery without fear of corrosion due to naphthenic acids, either in the pipe stills or in downstream units where various streams (e.g. distillates) from the pipestills are processed.

A small fraction of the carboxylic acid components of the feed can volatilize under thermal upgrader conditions and emerge from the reactor as part of the volatile hydrocarbon stream. The yield of this stream, its boiling range and acid (TAN) content will vary with conditions used in the thermal upgrader. This stream can comprise materials with boiling points up to a temperature close to that used in the thermal upgrader, e.g. 700–725° F. The yield can range from about 5 to 20 wt % of feed or more and TAN numbers can range from 1 to 3 or above. Thus, under some conditions, it may prove advantageous to further process the volatile hydrocarbon stream, or a portion thereof, to destroy the TAN prior to back blending this stream with the thermal upgrader liquid effluent. In one embodiment this treatment can be hydrotreatment in accordance with the procedure in WO/96/06899 based on PCT/NO95/00142. This process essentially includes treating the recovered fractions in the presence of hydrogen and a catalyst comprised of nickel or cobalt and molybdenum at temperatures of about 100–300° C. and pressures of about 1–50 bar, preferably 200–245° C. and 20–30 bars, and hydrogen treat rates of 300–5000 SCF/B, preferably 500–2000 SCF/B.

The reactor system for the thermal process is designed to provide liquid residence time at the chosen process temperature adequate to achieve the desired conversion and achieve rapid mass transfer to remove the inhibiting products of the reaction water and carbon dioxide. Suitable reactor systems would include mechanically stirred and jet stirred gas-liquid reactors, bubble columns, trickle bed reactors (loosely packed for enhanced mass transfer), membrane reactors, etc., etc. either staged or unstaged.

A preferred reactor system for the thermal process is a continuous flow bubble column where the purge gas or stripping gas is bubbled up through the liquid to be treated which flows continuously through the column. The liquid may flow upward, producing cocurrent contact, downward, producing countercurrent contact or crossflow. Generally, countercurrent contact is preferred since it is more efficient in stripping the products of the thermal reaction from the liquid phase.

More preferred, the bubble column may be empty of internals, yet more preferred baffled, or even further preferred, a separately staged system may be used. It is advantageous to have a staged system to achieve high levels of conversion, and the conversion increases with the number of stages in an asymptotic fashion. An empty column basically acts as a single stage in one vessel and has the advantage that it is simple, and that there are no internals to foul with contaminants that may be in the feed and/or trace reaction products that may be sticky. The baffled column gives a multistage reactor in one vessel and has rather simple internals to effect staging. The baffles may be disk and doughnut type or segmented and may or may not have holes for passage of gas vertically through the column. Generally, the baffled single vessel reactor will give more than one stage but less than the number of compartments produced by the baffling since some back mixing is always present in such systems.

A still more preferred configuration is a separately staged system which gives the number of stages equal to the number of separate vessels. For operational convenience in terms of flow of gas (and liquid in the case of countercurrent contact), the stages may be stacked vertically. Any number of stages may be used according to the design of the process, at least two stages are preferred for the level of conversion desired.

EXAMPLES

Two crudes from Venezuela were used in the following experiments. Properties are given in Table 1. Prior to use the feeds were subjected to a pre-flash at 250° F. to remove bulk water.

TABLE 1

| Source | Zuata | Campo-1-Bare |
|---|---|---|
| Feed Water Content, wt % | 1.3 | 3.8 |
| 1025+F Btms. (GCD), wt % | 50 | 50.5 |
| Viscosity, Kinetmatic, cSt @ 104° F. | 50535 | 22701 |
| Total Acid Number (TAN) (mg KOH/g Crude) | 4.5 | 2.4 |
| API | 7.8 | 9.7 |
| Tol. Equiv. | 15 | 27 |
| MicroCon Carbon, wt % | 15.2 | 14.9 |
| Heptane insol., wt % | 11.1 | 11.8 |
| Sulfur, wt % | 4.2 | 3.6 |
| Ni, wppm | 100 | 84 |
| V, wppm | 412 | 330 |

EXAMPLE 1

Dry Zuata feed was treated in a stiff ed autoclave reactor at 725° F. 30 psig for 60 minutes. The reactor was swept with argon, 380 SCF/Bbl., during the course of the thermal treatment to remove volatile products, including water and carbon oxides that resulted from decomposition of carboxylic acids (e.g., naphthenic acids). The reactor purge or sweep was sufficient to hold water partial pressure below 1 psia. In this manner, TAN was reduced by 90% and viscosity was reduced by 96.5%.

EXAMPLE 2

The procedures of Example 1 were repeated except that the autoclave was sealed. This operation simulates conditions in a coil visbreaker reactor wherein products of decomposition are in contact, under pressure, with the feed. In this mode of operation, the partial pressure of water in the autoclave reactor reached a maximum of 8.1 psia (calculated value based on moles of acid decomposed). The resultant reduction in TAN was 80.6% and viscosity was reduced 91.8%.

TABLE 2

| | Example 1 | Example 2 |
|---|---|---|
| Max Press., psig | 30 | 160 |
| Partial Press., psia | | |
| CO | 1.3 | 15.2 |
| CO2 | 0.1 | 1.3 |
| H2O | 0.7 | 8.1 |
| H2S | 2.8 | 35.4 |
| C4- | 6.5 | 83.5 |
| TAN Conv. % | 94.2 | 80.6 |
| Relative Rate | 1.0 | 0.4 |
| Viscosity, cSt @ 104° F. | 1767 | 4115 |

EXAMPLE 3

Experiments were carried out with dried Zuata feed to further demonstrate and to quantify the effect of water on TAN and Viscosity reduction under mild thermal treating conditions. The procedures of Example 1 were repeated except that water was fed to the reactor along with sweep gas to simulate operation with feed that had not been dried, i.e., not subjected to the pre-flash step of the present invention.

In one set of experiments, TAN conversion was measured as a function of increasing reaction severity, while purging the reactor with inert gas to hold water partial pressure below about 0.2 psia. In a second set of experiments within the same range of reaction severities, water was fed to the reactor along with inert sweep gas to simulate operation with a feed that contained 2.6 wt % bulk water. Water partial pressure was approximately 15 psia in this series of runs. In a third set of experiments, water was added to attain a partial pressure of 25–27 psia in the reactor.

Figure 2:
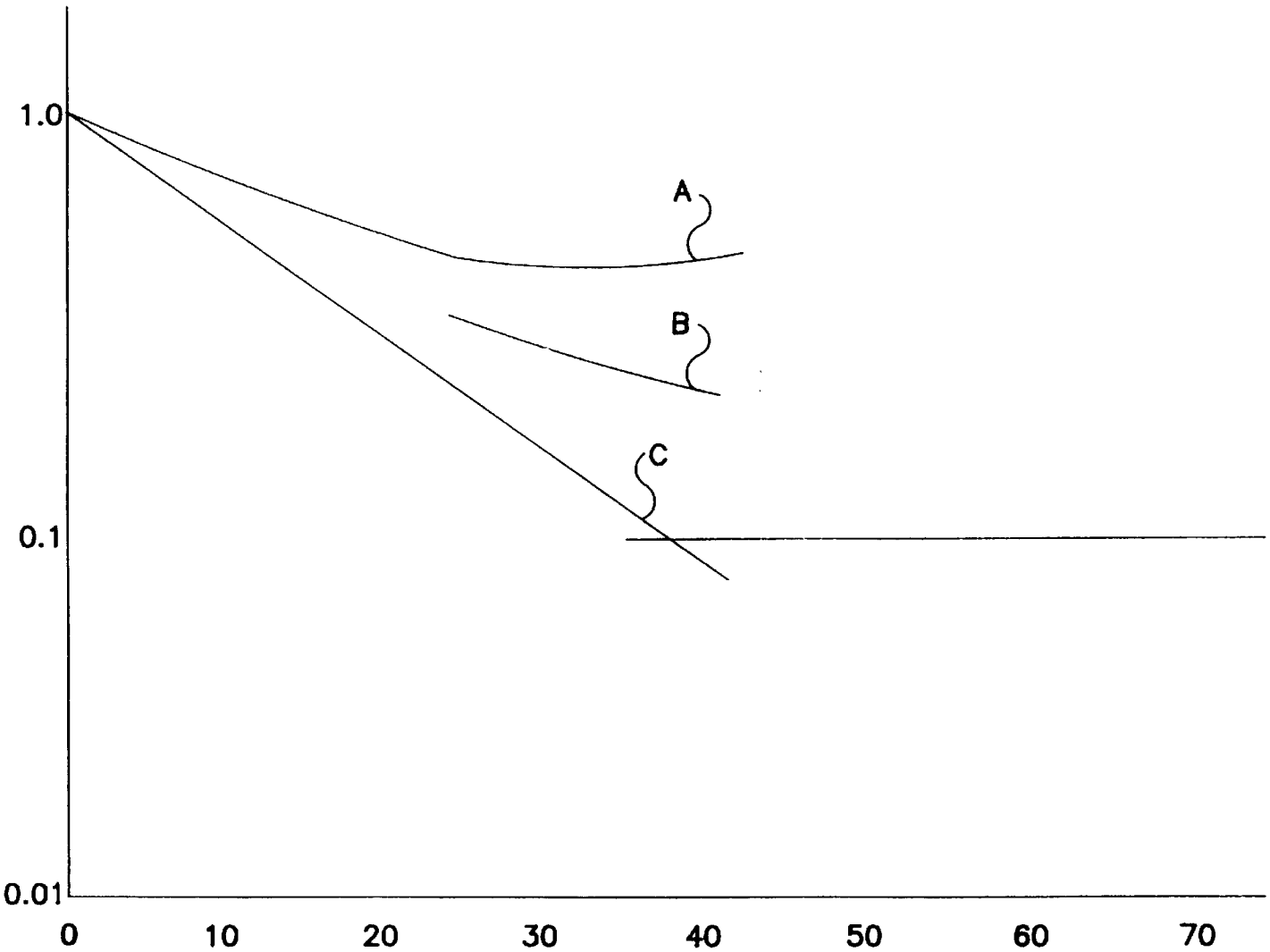
FIG. 2 shows the effect of water on TAN conversion, where the abscissa is reaction time (min.) at 725° F. and the ordinate is product TAN/feed TAN. Curve A was at 25 psia $H_2O$, curve B at 15 psia $H_2O$.

TAN reduction was suppressed with water present (FIG. 2). Viscosity reduction was also suppressed.

EXAMPLE 4

Figure 3:
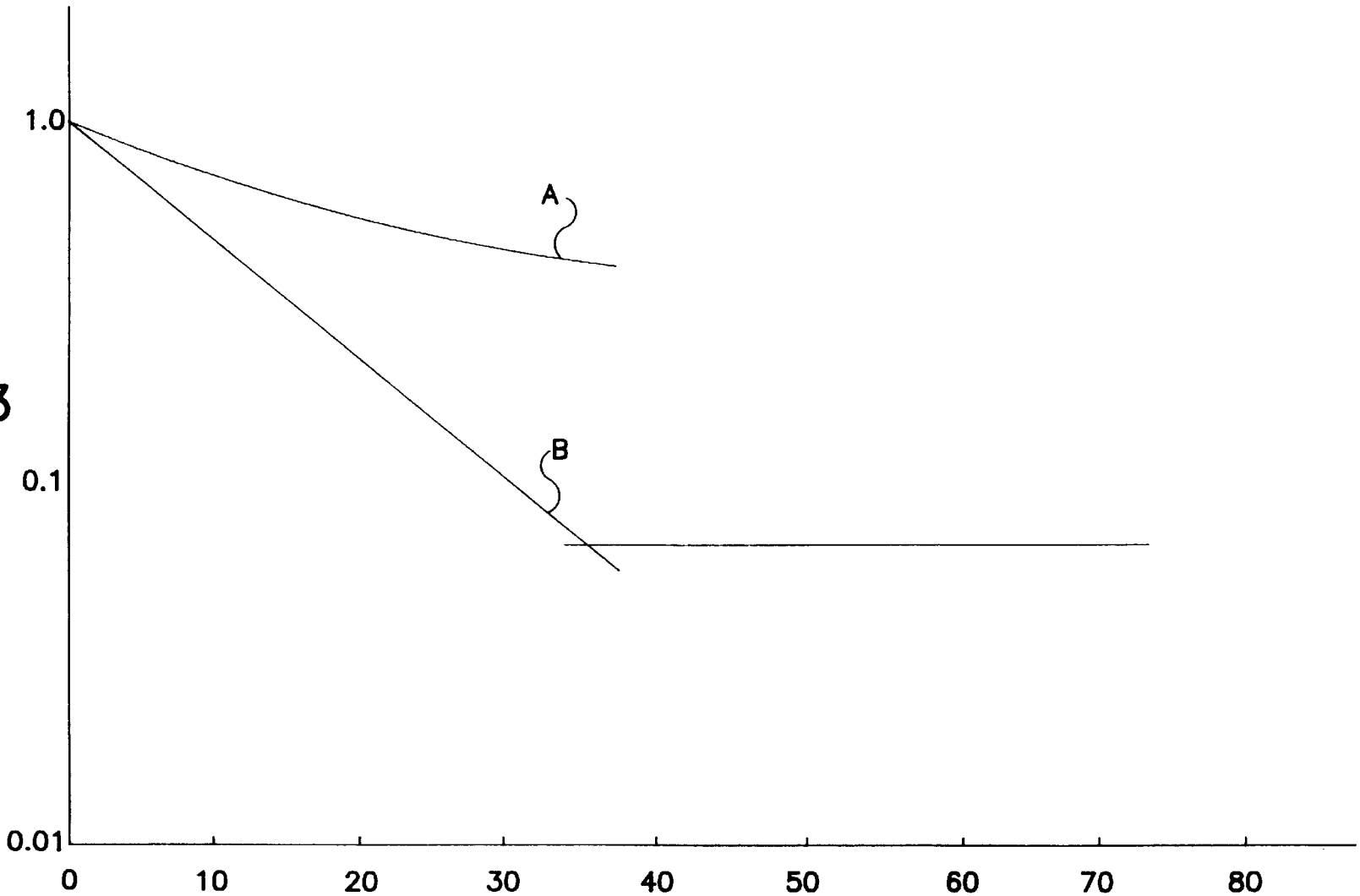
FIG. 3 is similar to FIG. 2; curve A being a 25 psia $H_2O$, curve B at 0.2 psia.

The experiments of Example 3 were repeated with the Campo-1-Bare feed (Table 1). With water present in the thermal treating reactor at 25 psia, TAN conversion was inhibited relative to operation with a dry feed wherein water partial pressure was less than 0.2 psia (FIG. 3). Viscosity reduction was also inhibited by the presence of water.

We claim:

1. A process for reducing the total acid number (TAN) of TAN and water containing oils comprising: (a) flashing the oil and removing therefrom substantially all of the water; (b) separately recovering vapors comprised of light gases, water, and light hydrocarbons, and separately recovering liquid oil; (c) thermally treating the liquid in a reaction zone in which the water partial pressure is maintained below about 10 psia; (d) recovering light hydrocarbons from the vapors of step (b) and combining at least a portion of the recovered light hydrocarbons with the treated liquid.

2. The process of claim 1 wherein the oil is subjected to desalting prior to step (a).

3. The process of claim 1 wherein the treated liquid has a TAN $\leqq$2.0 mg koH/mg oil.

4. The process of claim 1 wherein the water content of the oil after step (a) is less than about 0.5 wt %.

5. The process of claim 1 wherein a portion of the hydrocarbon gases recovered in claim 1 is combusted.

6. The process of claim 5 wherein the hydrocarbon gases are combusted for preheating the liquid recovered in step (b).

7. The process of claim 5 wherein the hydrocarbon gases are combusted to provide heat for the thermal treatment of the liquid recovered in step (b).

8. The process of claim 1 wherein the thermal treatment is effected at temperatures of 650–800° F.

9. The process of claim 1 wherein the flash temperature of step (a) ranges from about 250–700° F.

10. The process of claim 1 wherein a purge gas is injected into the thermal treating reacting zone to maintain a water partial pressure therein of less than about 10 psia.

11. The process of claim 1 wherein the reaction zone is a two stage bubble column.

12. The process of claim 1 wherein the water partial pressure in step (c) is maintained below about 5 psia.

13. The process of claim 1 wherein the water partial pressure in step (c) is maintained below about 2 psia.

14. The process of claim 13 wherein the oil is a Venezuelan heavy crude.

15. The process of claim 1 wherein the reaction severity of the thermal treatment ranges from 10 to about 80 equivalent seconds at 875° F.

16. The process of claim 1 wherein the thermal treatment is effected at temperatures of 675–775° F.

17. The process of claim 10 wherein the purge gas is contacted with the liquid in the reaction zone in a countercurrent manner.

18. The process of claim 17 wherein the treated liquid has a TAN of less than about 1.0 mg KOH/gm oil.

19. The process of claim 1 wherein the vapors are stripped of water.

20. The process of claim 1 wherein the TAN and water containing oil is diluted with a diluent.

21. The process of claim 20 wherein the diluent is naphtha.

22. The process of claim 20 wherein the vapors are stripped of water and diluent.

23. The process of claim 1 wherein hydrocarbon vapors are recovered from the thermal treating reaction zone of step (c) and a portion thereof is recombined with the treated liquid.

* * * * *